US008136668B2

(12) United States Patent
Katz et al.

(10) Patent No.: US 8,136,668 B2
(45) Date of Patent: Mar. 20, 2012

(54) BOX FOR RETAIL DISPLAY OF BREAKABLE ITEMS

(75) Inventors: Gerald I. Katz, Fort Lauderdale, FL (US); Marlen Rosales, Fort Lauderdale, FL (US)

(73) Assignee: Atico International, USA, Fort Lauderdale, FL (US)

( * ) Notice: Subject to any disclaimer, the term of this patent is extended or adjusted under 35 U.S.C. 154(b) by 0 days.

(21) Appl. No.: 12/489,097

(22) Filed: Jun. 22, 2009

(65) Prior Publication Data

US 2010/0320117 A1 Dec. 23, 2010

(51) Int. Cl.

| | |
|---|---|
| ***B65D 1/36*** | (2006.01) |
| ***B65D 73/00*** | (2006.01) |
| ***B65D 85/00*** | (2006.01) |
| ***B65D 6/04*** | (2006.01) |
| ***B65D 1/24*** | (2006.01) |
| ***B65D 81/32*** | (2006.01) |

(52) U.S. Cl. ..... 206/564; 206/471; 206/486; 206/526; 206/558; 220/507; 220/575; 426/115

(58) Field of Classification Search ..... 206/521, 206/461–471, 486–489, 526, 541–549, 557–558, 206/562–564, 587–590, 769–773, 775–782, 206/806; 220/500–502, 507, 523, 574–575; 426/115, 119, 120; D9/755, 761, 430, 431
See application file for complete search history.

(56) References Cited

U.S. PATENT DOCUMENTS

| | | | | | |
|---|---|---|---|---|---|
| 1,943,698 | A | * | 1/1934 | Schurmann | 220/575 |
| 2,561,022 | A | * | 7/1951 | Jones | 220/575 |
| 3,104,172 | A | * | 9/1963 | Wizelman | 426/119 |
| 3,107,027 | A | * | 10/1963 | Hong | 220/575 |
| 4,158,408 | A | * | 6/1979 | Thiessen | 206/526 |
| 4,874,083 | A | * | 10/1989 | Antoni et al. | 206/557 |
| D316,752 | S | * | 5/1991 | Ricketts | D9/430 |
| 5,213,214 | A | * | 5/1993 | Stringham | 206/564 |
| 5,220,999 | A | * | 6/1993 | Goulette | 206/508 |
| 6,042,856 | A | * | 3/2000 | Sagan et al. | 426/120 |
| D451,018 | S | * | 11/2001 | Chen et al. | D9/761 |
| 6,502,692 | B1 | * | 1/2003 | Gentle | 220/523 |
| 6,615,986 | B2 | * | 9/2003 | Pirro et al. | 206/467 |
| 6,659,281 | B2 | * | 12/2003 | Gaffney et al. | 206/471 |
| 6,863,912 | B2 | * | 3/2005 | Lin | 426/120 |
| 6,905,017 | B1 | * | 6/2005 | Sarnoff et al. | 206/518 |
| 7,156,226 | B1 | * | 1/2007 | Van Sickle | 220/507 |
| 7,882,957 | B2 | * | 2/2011 | Ochi | 206/711 |
| 2007/0062965 | A1 | * | 3/2007 | Anderson et al. | 220/522 |

* cited by examiner

*Primary Examiner* — Bryon Gehman
(74) *Attorney, Agent, or Firm* — Casimir Jones, S.C.

(57) ABSTRACT

The present invention relates to articles of manufacture for the packaging of brittle, elongated, and/or asymmetrically-shaped retail items for retail display to consumers. In some embodiments, the article of manufacture serves to protect the retail items from breakage during display or transit while allowing ready visual inspection by the consumer. In a preferred embodiment, the retail items are candy canes.

9 Claims, 2 Drawing Sheets

BOX FOR RETAIL DISPLAY OF BREAKABLE ITEMS

FIELD OF INVENTION

The present invention relates to articles of manufacture for the packaging of brittle, elongated, and/or asymmetrically-shaped retail items for retail display to consumers. In a preferred embodiment, the retail items are candy canes.

BACKGROUND

Certain consumable items present challenges for packaging and retail display. Retail items that are brittle, elongated, and asymmetrically shaped, for example, are easily broken in many conventional types of packaging structures. Such breakage during the course of shipment and retail display results in a revenue loss for the merchant, and/or an unpleasant purchasing experience for the consumer. However, packaging that attempts to prevent breakage by completely surrounding the breakable retail item with cushioning material, for example, obscures the consumer's view of the retail item and may therefore discourage purchasing.

As one example, holiday sweets such as candy canes are easily shattered during the transition from manufacturer to retailer to consumer. The brittle consistency and elongated and asymmetrical shape of the candy cane makes it particularly susceptible to breakage. However, while it would be desirable to prevent such breakage and loss by surrounding candy canes with shock-absorbing material, the retailer is also motivated to display them in an ornamentally appealing way that will attract the attention of the consumer and thereby increase "impulse purchases."

Therefore, there is a need for improved articles of manufacture for the packaging and display of elongated, asymmetrically-shaped, and brittle retail items, such as candy canes.

DEFINITIONS

Figure 1:
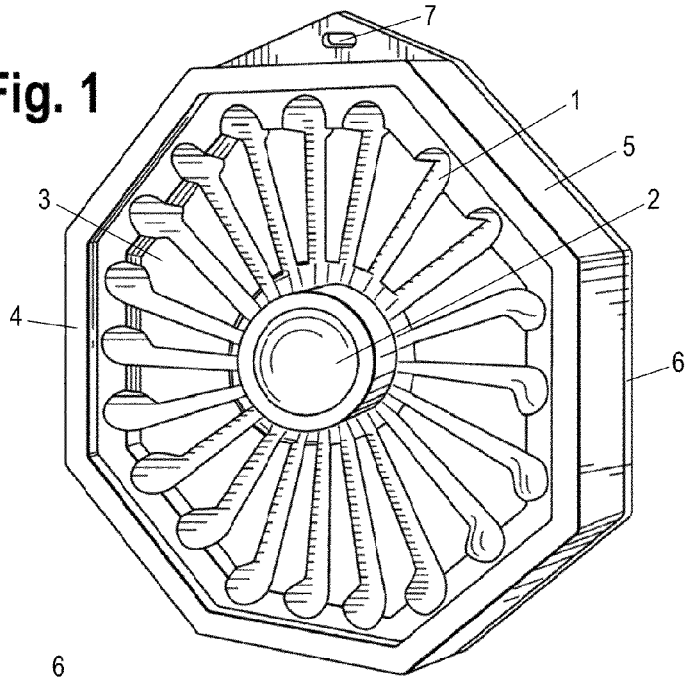
FIG. 1 shows a front perspective view of an embodiment of the invention.

As used herein, the term "retail item" refers to any item offered to a consumer for purchase.

As used herein, the term "brittle" refers to a physical property of an item that renders it susceptible to breakage or fracture when it is subjected to physical force (e.g., stress), without limitation to the nature of physical force. Physical events that may lead to breakage of brittle items include but are not limited to falls, static weight-induced pressure (e.g., pressure due to weight of adjacent packaged items), and temperature-induced pressure (e.g., expansion or contraction of surrounding materials due to elevated or depressed temperature). Brittle materials exhibit low deformation or strain when subjected to stress, and absorb relatively little energy before fracturing. In general, brittle materials fail in tension rather than shear. Examples of materials with brittle consistency include but are not limited to hard candy, glass, and brittle polymers such as polystyrene. A brittle glass or polymer may be defined as having a strain energy release rate ($G_{Ic}$) of 0.5 or less.

SUMMARY OF THE INVENTION

The present invention relates to articles of manufacture for the packaging of brittle, elongated, asymmetrically-shaped retail items for retail display to consumers. In a preferred embodiment, the retail items are candy canes.

In certain embodiments, the invention provides article of manufacture for storage or display of at least one retail item, comprising a region with at least one depression into which a retail item can be fitted; a customer-oriented surface, the majority of the customer-oriented surface being comprised of a transparent material; a rigid support structure formed by a back surface, side surface, and at least a periphery region of the customer-oriented surface; and a feature that allows the article of manufacture to be hung for display to the retail consumer. In some embodiments, the article of manufacture encompasses a plurality of retail items. In some embodiments, the retail items have properties selected from the group consisting of brittle consistency, elongated shape, and asymmetrical shape. In some embodiments, the retail items are candy canes. In some embodiments, the region with at least one depression is separable from the rigid support structure. In some embodiments, the region with at least one depression and said rigid support structure form an integrated unit. In some embodiments, the plurality of retail items are arrayed 360° around a central region. In some embodiments, the central region permits display of at least one additional retail item. In some embodiments, the arrayed retail items and the retail item(s) in the central region are different. In some embodiments, the rigid support structure permits a plurality of articles of manufacture to be stacked on one another. In some embodiments, the rigid display structure is made of a material such as pasteboard, cardboard, plastic, metal, wood, a combination thereof, or a composite thereof. In some embodiments, the feature that allows the article of manufacture to be hung for display comprises a hole.

In certain embodiments, the invention provides a method for retail display of retail items with properties selected from the group consisting of brittle consistency, elongated shape, and asymmetric shape using the article of manufacture described herein.

DETAILED DESCRIPTION OF THE INVENTION

The following example is provided in order to demonstrate and further illustrate a preferred embodiment and certain aspects of the present invention and is not to be construed as limiting the scope thereof.

In the following figures, the same reference numerals are used to identify the same components in the various views and alternate embodiments.

Referring now to FIG. 1, there is generally illustrated an article of manufacture (e.g., a box) in which exists a plurality of depressions, 1 corresponding to one such depression, into which a retail item (e.g., candy cane) may be easily fitted. The region bearing the plurality of depressions along with retail items fitted into the depressions when the box is in a fully assembled state (see, e.g., the embodiment shown in FIG. 7) forms the interior of the box. In the embodiment shown in FIG. 1, the plurality of retail items are arrayed 360° around a central region, 2. The embodiment bears a customer-oriented surface, 3, which is made of transparent material that extends across the majority of the customer-oriented surface. The periphery of the customer-oriented surface, 4, comprises a border of rigid support structure. The rigid support structure of the periphery of the customer-oriented surface is contiguous with a rigid support structure, 5, forming the sides of the box. The side rigid support structure is further contiguous with a back rigid support structure, 6, which forms a surface parallel to the customer-oriented surface. In the embodiment shown in FIG. 1, a hole, 7, permits hanging of the article of manufacture for retail display (e.g., on a post, hook, beam, or similar structure).

Figure 2:
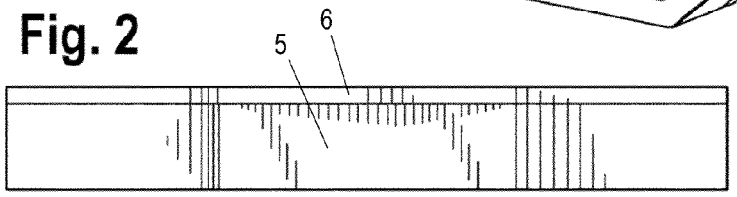
FIG. 2 shows a top plan view of an embodiment of the invention.

Referring now to FIG. 2, a top view of an embodiment of the invention is shown. Included in this view is the rigid support structure, 5, forming the sides of the box, and the rigid support structure, 6, forming the back of the box.

Figure 3:
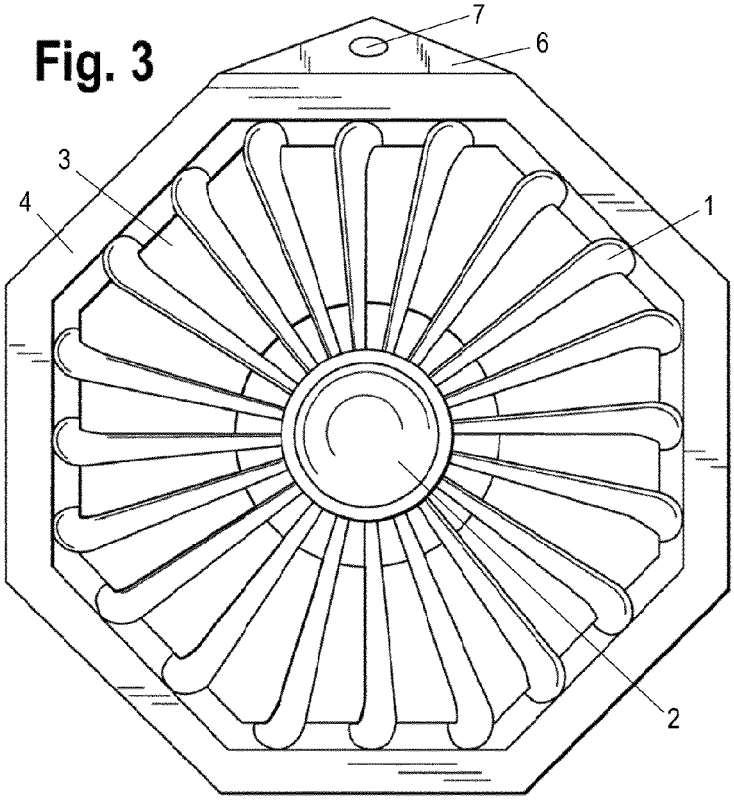
FIG. 3 shows a front elevational view of an embodiment of the invention.

Referring now to FIG. 3, a front elevational view of an embodiment of the invention is shown. Features 1 through 4 and 6 through 7 are as described above for FIG. 1. In this view, the rigid support structure forming the sides of the box cannot be seen. FIG. 3 demonstrates a view of an embodiment of the invention that would be perceived by a consumer directly facing this embodiment at eye level.

Figure 4:
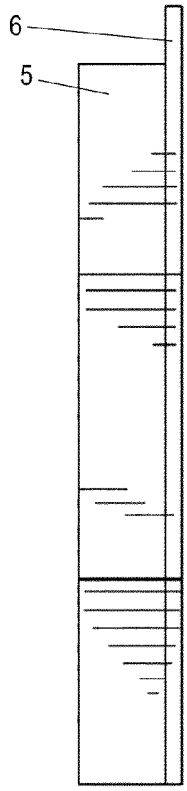
FIG. 4 shows a right side elevational view of an embodiment of the invention, the right and left side elevational views being mirror images.

Referring now to FIG. 4, a right side elevational view of an embodiment of the present invention is shown. Included in this view are features 5 and 6 as described above for FIG. 1. In this view, the customer-oriented surface 3, region of a plurality of depressions 1, central region 2, periphery of the customer-oriented surface 4, and hole for hanging the box 7 cannot be seen. A left side elevational view of this embodiment of the present invention would be a mirror image of the right side elevational view shown.

Figure 5:
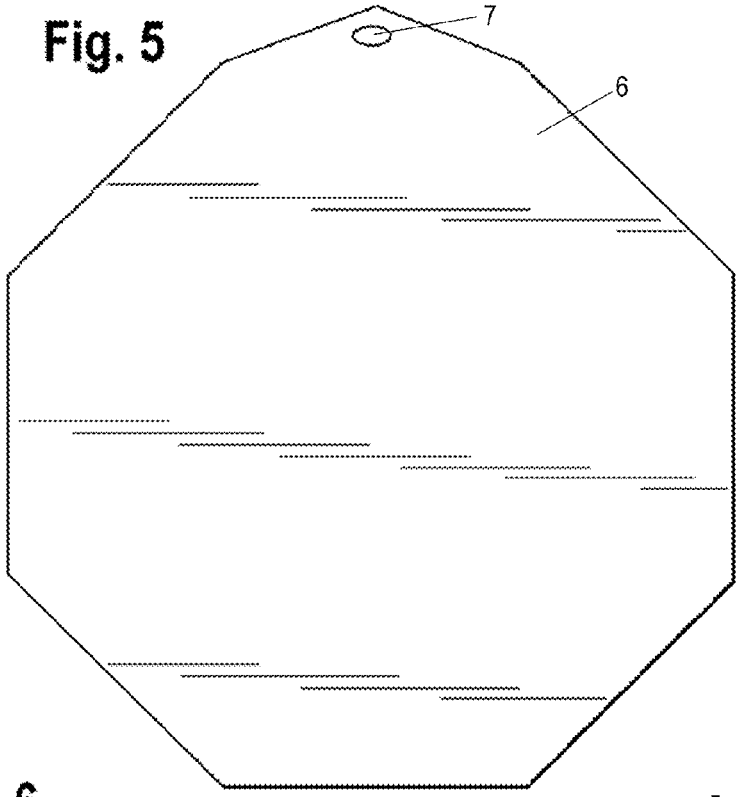
FIG. 5 shows a rear elevational view of an embodiment of the invention.

Referring now to FIG. 5, a rear elevational view of an embodiment of the present invention is shown. In this view, the rigid support structure forming the back of the box, 6, is seen. This surface is parallel to the customer-oriented surface, 3, and rigid support structure forming the periphery of the customer-oriented surface, 4, neither of which are seen in this view. Also hidden from view are the plurality of depressions 1, the central region 2, and the rigid support structure forming the sides of the box, 5. The hole for hanging the box 7 can be seen.

Figure 6:
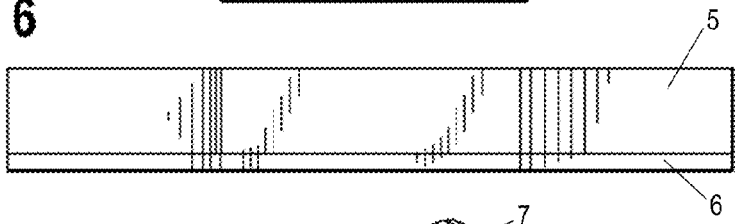
FIG. 6 shows a bottom plan view of an embodiment of the invention.

Referring now to FIG. 6, a bottom plan view of an embodiment of the present invention is shown. In this view, the rigid support structure forming the sides of the box, 5, and the rigid support structure forming the back of the box, 6, are shown. Hidden from view are all other features (1 through 4 and 7) described above for FIG. 1.

Figure 7:
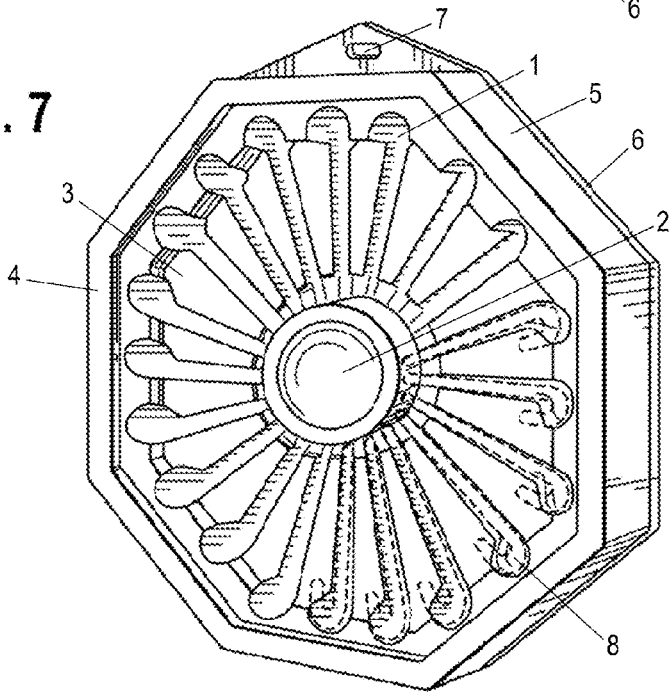
FIG. 7 shows a front perspective view thereof showing of an embodiment of the invention partially filled with candy canes, said candy canes being depicted by dashed lines.

Referring now to FIG. 7, a front perspective view of an embodiment of the present invention is shown. Features 1 through 7 as described above for FIG. 1 are visible. The box is shown as partially filled with a plurality of candy canes, 8 corresponding to one such candy cane, which are depicted by dashed lines.

Various modifications and variations of the described invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in packaging engineering or related fields are intended to be within the scope of the following claims.

We claim:

1. An article of manufacture for storage or display of a plurality of candy canes, comprising:

a region comprising twenty depressions into which each said depression a candy cane is fitted, wherein said depressions are radially arrayed 360° around and extending from a central region, wherein each of said depressions is asymmetrically shaped; wherein each said depression secures in place said candy cane and substantially immobilizes said candy cane to said depression;

a customer-oriented surface opposing said plurality of depressions, the majority of said customer-oriented surface being comprised of a transparent material;

a rigid support structure formed by a back surface, side surface, and at least a periphery region of the customer-oriented surface; and a feature that allows said article of manufacture to be hung for display to a retail consumer.

2. The article of manufacture of claim 1, wherein each of said depressions has an elongated shape.

3. The article of manufacture of claim 1, wherein said region and said rigid support structure form an integrated unit.

4. The article of manufacture of claim 1, wherein said central region permits display of at least one additional retail item.

5. The article of manufacture of claim 4, wherein the candy canes and the at least one additional retail item in said central region are different.

6. The article of manufacture of claim 1, wherein the rigid support structure permits a plurality of the article of manufacture to be stacked on one another.

7. The article of manufacture of claim 1, wherein the rigid display structure is made of a material selected from the group consisting of pasteboard, cardboard, plastic, metal, wood, and a combination thereof.

8. The article of manufacture of claim 1, wherein said feature that allows said article of manufacture to be hung for display comprises a hole.

9. A method for retail display of retail items, comprising:

a) providing the article of manufacture of claim 1 to create a retail display assembly;

b) placing said retail display assembly in a location viewable by a customer.

* * * * *